US008925742B1

(12) United States Patent
Chitayat et al.

(10) Patent No.: US 8,925,742 B1
(45) Date of Patent: Jan. 6, 2015

(54) FOLDING DISHRACK WITH ARTICULATING TINES

(76) Inventors: David Dennys Chitayat, Shanghai (CN); Heather Tomasetti, Shanghai (CN); Pieter Schouten, Berkeley, CA (US)

( * ) Notice: Subject to any disclaimer, the term of this patent is extended or adjusted under 35 U.S.C. 154(b) by 190 days.

(21) Appl. No.: 13/523,649

(22) Filed: Jun. 14, 2012

(51) Int. Cl.
*A47L 19/04* (2006.01)

(52) U.S. Cl.
USPC ..... 211/41.6; 211/132.1

(58) Field of Classification Search
CPC ..... A47L 19/02; A47L 19/04; A47L 15/50; A47L 15/503; A47J 47/20; A47B 81/04
USPC ..... 211/41.1, 41.2, 41.3, 41.4, 41.5, 41.6, 211/41.8, 41.9, 85, 85.25, 200, 195, 132.1, 211/133.6; 220/571, 572; 4/644, 656, 657, 4/658; 34/192, 238
See application file for complete search history.

(56) References Cited

U.S. PATENT DOCUMENTS

| | | | | | |
|---|---|---|---|---|---|
| 222,542 | A | * | 12/1879 | Stearns | 211/200 |
| 329,150 | A | * | 10/1885 | Eaton | 211/200 |
| 946,977 | A | * | 1/1910 | Latham | 211/41.6 |
| 1,373,975 | A | * | 4/1921 | Riddle | 211/41.6 |
| 1,714,629 | A | | 5/1929 | Rodin | |
| 1,789,232 | A | * | 1/1931 | Hertz | 211/41.3 |
| 1,835,232 | A | * | 12/1931 | Lord | 211/85 |
| 2,443,404 | A | * | 6/1948 | Tallarico | 211/41.4 |
| 2,479,118 | A | | 8/1949 | Jenness | |
| 2,516,088 | A | | 7/1950 | Einhorn | |
| 2,686,598 | A | | 8/1954 | Brecht | |
| 2,936,898 | A | * | 5/1960 | Miguez | 211/41.3 |
| 3,952,875 | A | | 4/1976 | Lombardo | |
| D247,416 | S | * | 3/1978 | Berman et al. | D32/55 |
| D252,251 | S | * | 7/1979 | Lundahl | D32/55 |
| 4,212,400 | A | * | 7/1980 | Buchsteiner | 211/41.6 |
| 4,221,299 | A | * | 9/1980 | Taylor | 211/41.6 |
| D258,928 | S | * | 4/1981 | Buchsteiner | D32/55 |
| 4,328,899 | A | * | 5/1982 | Krusche | 211/41.6 |
| 4,927,033 | A | | 5/1990 | Patera et al. | |
| 6,038,784 | A | * | 3/2000 | Dunn et al. | 34/104 |
| 6,125,548 | A | * | 10/2000 | Dunn et al. | 34/104 |
| 6,170,676 | B1 | * | 1/2001 | Patadia et al. | 211/41.6 |
| 6,357,605 | B1 | * | 3/2002 | Martorella | 211/41.6 |
| 6,502,704 | B2 | * | 1/2003 | Martorella et al. | 211/41.6 |
| 6,516,956 | B2 | * | 2/2003 | Martorella et al. | 211/41.6 |
| 6,547,080 | B1 | * | 4/2003 | Guard | 210/464 |
| 6,640,982 | B1 | * | 11/2003 | Bjerke | 211/85.15 |
| 6,718,788 | B1 | * | 4/2004 | Shuck | 62/291 |
| 7,207,074 | B1 | * | 4/2007 | Stewart | 4/637 |
| 7,325,695 | B2 | * | 2/2008 | Yang et al. | 211/41.3 |
| 7,458,470 | B2 | * | 12/2008 | Jerstroem et al. | 211/41.4 |
| 7,523,854 | B2 | * | 4/2009 | Gray | 229/114 |
| 8,087,108 | B2 | * | 1/2012 | Burns et al. | 4/657 |

(Continued)

*Primary Examiner* — Jonathan Liu
*Assistant Examiner* — Stanton L Krycinski
(74) *Attorney, Agent, or Firm* — Patent Law Offices Michael E. Woods; Michael E. Woods

(57) ABSTRACT

A system and configuring method for a dish rack system includes a tray providing a first generally planar draining surface having a first surface area with a first width and a first length; and a folding platform including a pair of half trays rotatably coupled to each other, the folding platform including an unfolded mode and a folded mode, with the folding platform configured to be supported by the tray when in the unfolded mode.

13 Claims, 6 Drawing Sheets

(56) References Cited

U.S. PATENT DOCUMENTS

| | | | | | |
|---|---|---|---|---|---|
| RE43,349 | E | * | 5/2012 | Dunn et al. | 34/104 |
| RE43,635 | E | * | 9/2012 | Dunn et al. | 34/104 |
| D673,366 | S | * | 1/2013 | Schumann et al. | D3/294 |
| D692,199 | S | | 10/2013 | Huang | |
| 8,573,410 | B2 | | 11/2013 | Chalifoux | |
| 2001/0040141 | A1 | * | 11/2001 | Martorella et al. | 211/41.6 |
| 2002/0084233 | A1 | * | 7/2002 | Martorella et al. | 211/41.6 |
| 2004/0238464 | A1 | * | 12/2004 | Cheung | 211/41.3 |
| 2005/0040120 | A1 | * | 2/2005 | Pine et al. | 211/41.6 |
| 2005/0145583 | A1 | * | 7/2005 | Martorella et al. | 211/41.6 |
| 2006/0283817 | A1 | * | 12/2006 | Yang et al. | 211/41.4 |
| 2007/0144984 | A1 | * | 6/2007 | Sullivan et al. | 211/41.3 |
| 2007/0151937 | A1 | | 7/2007 | Gillisie | |
| 2008/0029465 | A1 | | 2/2008 | Yang et al. | |
| 2008/0149644 | A1 | * | 6/2008 | Piacenza et al. | 220/572 |
| 2008/0263762 | A1 | * | 10/2008 | Burns et al. | 4/657 |
| 2008/0283480 | A1 | | 11/2008 | Segall et al. | |
| 2008/0308509 | A1 | * | 12/2008 | Giuseppe | 211/41.3 |
| 2009/0152218 | A1 | * | 6/2009 | Yang et al. | 211/41.4 |
| 2009/0242495 | A1 | * | 10/2009 | Moberg | 211/41.8 |
| 2012/0138550 | A1 | * | 6/2012 | Wisniewski | 211/41.3 |

* cited by examiner

FOLDING DISHRACK WITH ARTICULATING TINES

BACKGROUND OF THE INVENTION

The present invention relates generally to structures and methods for manually draining and drying objects, and more specifically, but not exclusively, to a folding and adjustable dish rack for draining and drying food service items.

There are a wide variety of dish racks that are known in the prior art. Many of these have some type of folding arm or element to aid in storage when not being used. A typical arrangement is to place a dish rack on a large flat draining tray that has an area generally somewhat larger than a footprint of the dish rack portion. To prepare for storage, the dish rack may be folded to some degree and then it and the tray are stowed away. A user of conventional solutions often must choose between a solution that may be used to dry large amounts of plates, cups, bowls, glasses, and the like (which takes up a correspondingly large amount of space when not in use) or a compact dish rack that takes up less room but imposes to much limit on how much can be dried at a time.

Conventional designs are not optimized for full-capacity use when drying large amounts of food service items (e.g., glasses, bowls, plates, utensils, and an occasional odd-shaped object) while being able to be folded into a small compact design. What is needed is a dish rack that is configured for full-capacity use when drying large amounts of food service items (e.g., glasses, bowls, plates, utensils, and an occasional odd-shaped object) while being able to be folded into a small compact design when not in use/stored.

BRIEF SUMMARY OF THE INVENTION

Disclosed is a system and method for a dish rack that is configured for full-capacity use when drying large amounts of food service items (e.g., glasses, bowls, plates, utensils, and an occasional odd-shaped object) while being able to be folded into a small compact design when not in use/stored.

The following summary of the invention is provided to facilitate an understanding of some of technical features related to foldable/adjustable dish racks, and is not intended to be a full description of the present invention. A full appreciation of the various aspects of the invention can be gained by taking the entire specification, claims, drawings, and abstract as a whole. The present invention is applicable to other drying/draining scenarios in addition to dish racks.

A dish rack system includes a tray providing a first generally planar draining surface having a first surface area with a first width and a first length; and an independent discrete folding platform including a pair of half trays rotatably coupled to each other, the folding platform including an unfolded mode and a folded mode, with the folding platform configured to be supported by the tray when in the unfolded mode; wherein the pair of half trays are aligned in a plane and define a second generally planar draining surface with a centrally disposed drain region when the folding platform is in the unfolded mode; wherein the pair of half trays are generally parallel to each other when the folding platform is in the folded mode; and wherein the second generally planar draining surface includes a second surface area with a second width and a second length, the second surface area greater than the first surface area.

A method for configuring a dish rack system includes a) placing a tray with a first draining surface in fluidic communication with a selectively closeable closure, the first draining surface having a first surface area; b) unfolding a folding platform that defines a second draining surface with a second surface area larger than the first surface area, the second draining surface defining a central drain region; and thereafter c) supporting the folding platform on the tray with the central drain region overlying the first draining surface.

Other configuration modes include use of one or more pivoting tine members coupled to the second draining surface of the folding platform. In other modes, such one or more pivoting tine members may be repeatedly attachable to, and detachable from, the second draining surface. A separate cup for utensils and the like has a stowage-area defined in the tray. When installed/deployed, the cup is accessible from its stowage on the tray even when the folding platform is disposed on the tray.

Other features, benefits, and advantages of the present invention will be apparent upon a review of the present disclosure, including the specification, drawings, and claims.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION OF THE INVENTION

Embodiments of the present invention provide a system and method for a dish rack that is configured for full-capacity use when drying large amounts of food service items (e.g., glasses, bowls, plates, utensils, and an occasional odd-shaped object) while being able to be folded into a small compact design when not in use/stored. The following description is presented to enable one of ordinary skill in the art to make and use the invention and is provided in the context of a patent application and its requirements.

Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Figure 1:
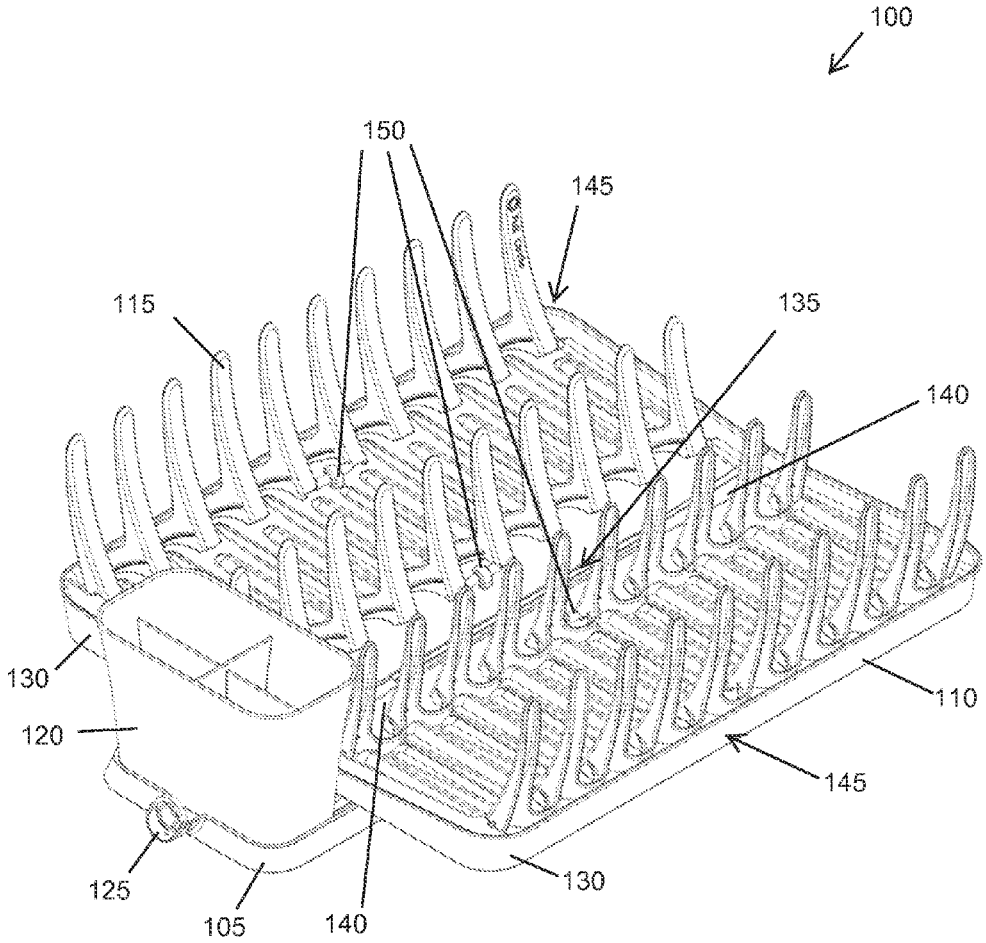
FIG. 1 illustrates a perspective view of a dish rack system.
Figure 2:
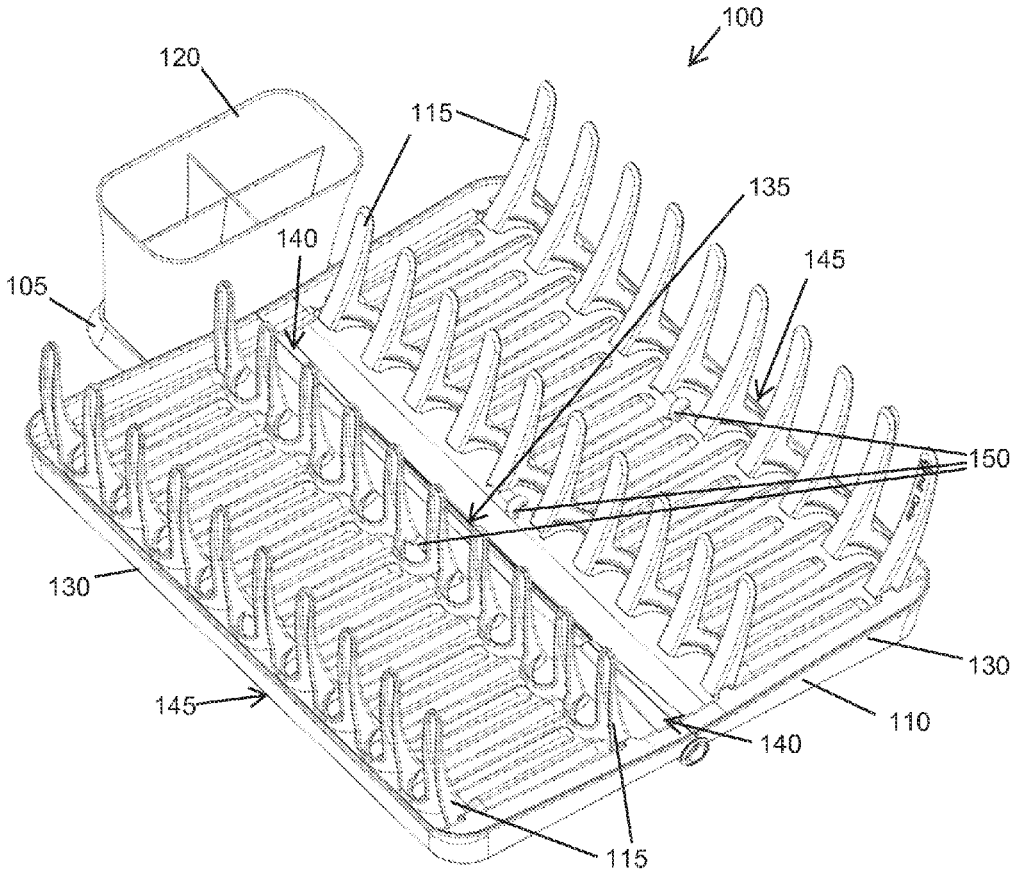
FIG. 2 illustrates a reverse perspective view of the dish rack system of FIG. 1.
Figure 3:
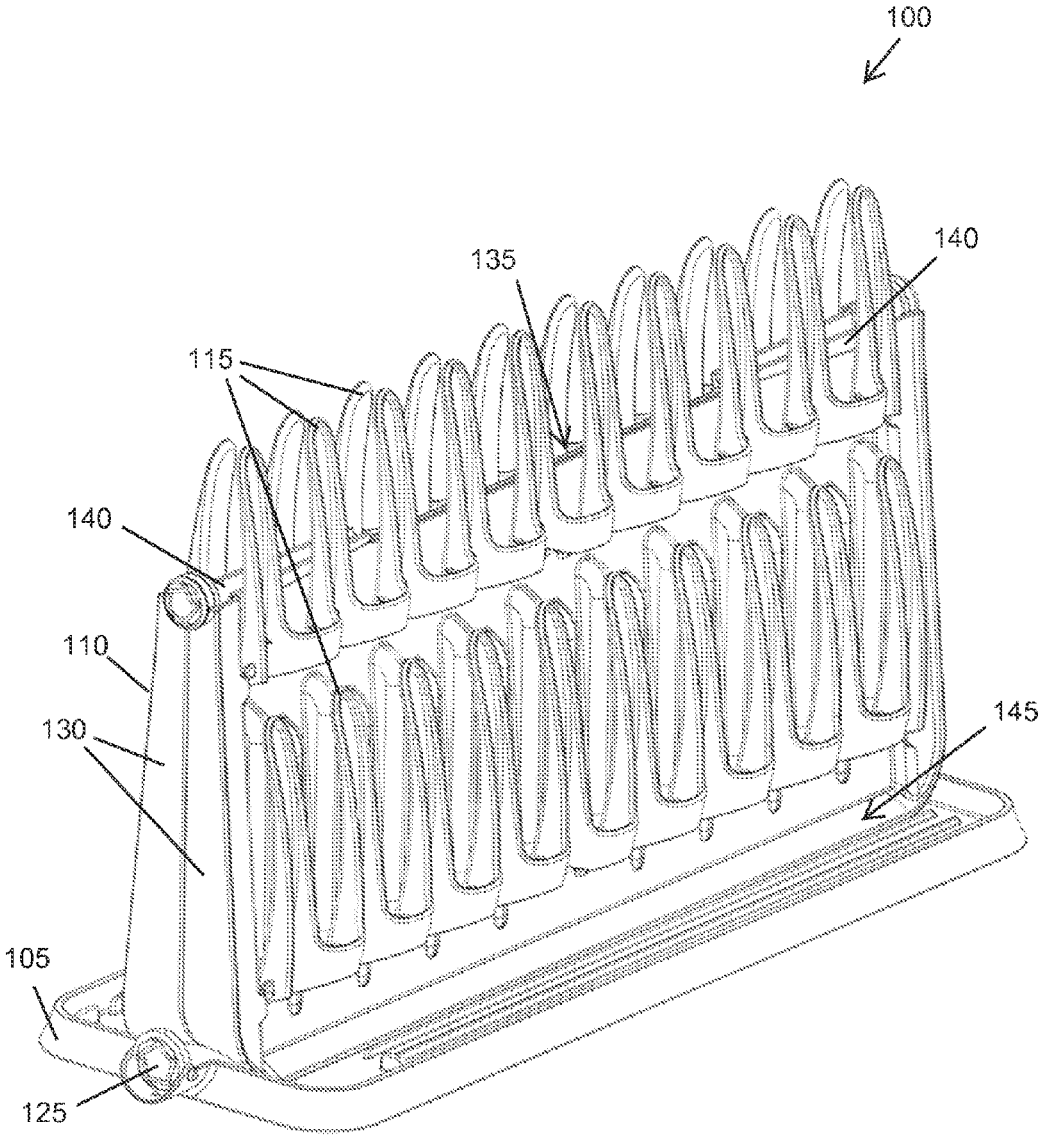
FIG. 3 illustrates a perspective view of a folded mode for the dish rack system of FIG. 1.
Figure 4:
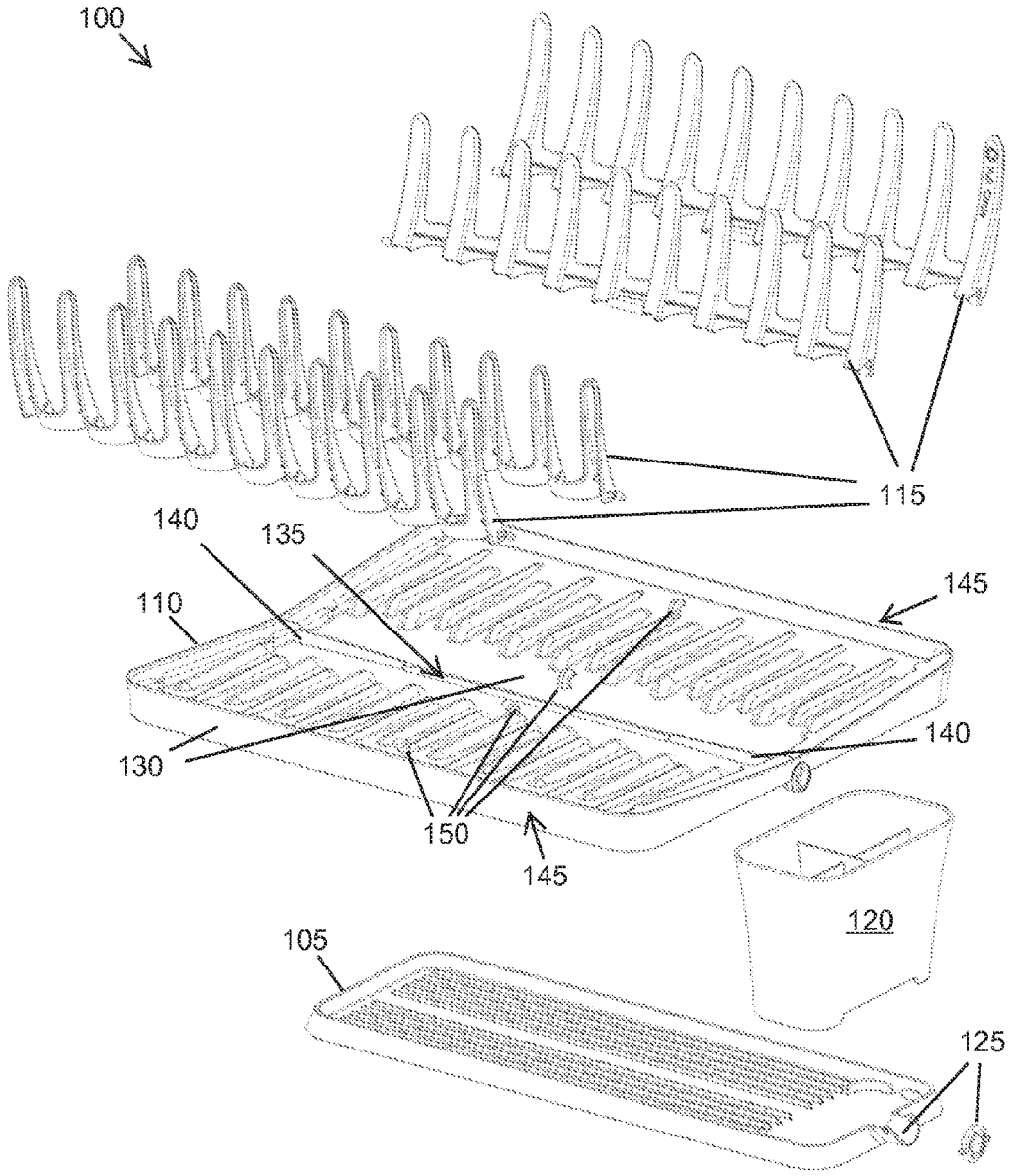
FIG. 4 illustrates an exploded view of components of the dish rack system of FIG. 1.

FIG. 1 illustrates a perspective view of a dish rack system 100, FIG. 2 illustrates a reverse perspective view of dish rack system 100, FIG. 3 illustrates a perspective view of a folded mode for dish rack system 100, and FIG. 4 illustrates an exploded view of components of dish rack system 100. Dish rack system 100 is multi-adjustable and foldable which allows it to be customized into many different configurations as appropriate for a user, including a very compact mode for stowage.

Dish rack system 100 includes a tray 105, a folding platform 110, a set of N number (e.g., N=4) of pivoting tine members 115, a cup 120, and drain closure 125. These components are preferably made of a molded polymer that is rigid and stain-resistant. Tray 105 is a single unitary rectilinear draining foundation that provides a first draining surface to receive liquid, contain the liquid within perimeter walls, and direct the received liquid towards closure 125. Tray 105 is sized with a smaller footprint (i.e., surface area for first draining surface) than conventional dish racks as it is narrower than a breadth of folding platform 110 while having a generally matching length. Breadth of tray 105 is configured to meet three design goals: a) to support folding platform 110 when folding platform 110 is deployed in an unfolded-draining configuration, b) completely underlie drain regions of folding platform 110 to ensure that liquid draining through these drain regions are captured by tray 105; and c) be large enough to independently directly support a desired number M (e.g., M=4) of upended glasses such as wine glasses, champagne glasses, or the like.

Folding platform 110 includes two pivotally coupled half trays 130 that collectively provide a second draining surface when unfolded. Second draining surface has a larger surface area than the first draining surface of tray 105. The second draining surface is also a rectilinear draining foundation that receives liquid, contains the liquid within perimeter walls, and directs the received liquid towards a drain region 135 at the center of folding platform 110. Drain region 135 is further constrained towards the center of folding platform 110 by use of a pair of sloped lateral hinges 140 that help to direct fluid flow appropriately. Lateral edges 145 are configured (for example in FIG. 1 they are made "taller") to extend further upwards than necessary for a simple drain/liquid control function in order to support folding platform 110 upright when it is folded (for example, they collectively act as a "stand" for folding platform 110 when folded). A footprint of folding platform 110, in some embodiments, matches the perimeter of the first draining surface when folding platform 110 is folded.

Tray 105 is configured to underlie drain region 135 to catch and control liquid exiting from folding platform 110. Preferably, half trays 130 are rotatably joined to each so that a) the second draining surface is pitched towards drain region 135, b) folding platform 110 may be unfolded to lay flat, c) folding platform may be folded in half with outside draining surfaces on the outside after folding, and d) folding platform 110 is able to stand on its own after folding.

Preferably one or more of the draining surfaces are provided with ribs/raised elements to lift objects to be drained from the respective draining surface and to limit impediments to liquid run-off as fluid flows from second draining surface to first draining surface through central drain region then to closure 125.

The second draining surface is configured with one or more pivot points 150 that releasably engage portions of each pivoting tine member 115 of the set. In addition to, or in lieu of, pivot points 150 other attachment mechanisms may be used, such as incorporating one or more pins into pivoting tine members 115, each pin rotatably engaging a mounting point of folding platform 110. (FIG. 4 illustrates one such use with lateral pins in each pivoting tine member 115 removeably and rotatingly engaging mating lateral slots/channels in edges of each half tray 130 to support the central pivot points 150.) Each pivoting tine member 115 rotates about its associated pivot point 150 in order to extend outwardly from the second draining surface or lie flat against half tray 130. Folding platform 110 rotates about a central axis when folding and unfolding, with each pivoting tine member 115 rotating about an axis parallel to this central axis. When rotating from the outwardly extending mode to the flat mode, each pivoting tine member 115 rotates toward the central axis of folding platform 110.

In the outwardly extending mode, each pivoting tine member 115 makes a generally perpendicular angle with the second draining surface that is preferably slightly greater than ninety degrees. Each tine of each pivoting tine member 115 is curved outward as well, with the tine members and attachment to second draining surface configured to support objects while resisting folding or buckling or the like.

Cup 120 optionally includes interior walls that divide an internal volume into sections. These sections, individually and collectively promote vertical support of utensils for drying and storage. Not shown, cup 120 preferably includes holes, gaps, perforations, or the like to permit liquid to exit from the bottom. Tray 105 optionally includes a cup-stowage area near closure 125, with cup 120 having an exterior cross-section perimeter with a length (longest dimension of cup 120) about equal to a width of tray 105.

Closure 125 includes a spout and an optional door, plug, valve, or the like to selectively direct and control liquid flow out of closure 125. Closure 125 includes an open mode and a closed mode. Tray 105 is preferably sloped toward closure 125 so that liquid flows off the first draining surface towards closure 125. When closure 125 is in the closed mode, liquid draining from the first draining surface collects on tray 105 near closure 125. When closure 125 is in the open mode, liquid flowing on the first draining surface flows toward closure 125 and exits as directed by the spout.

In operation, tray 105 is placed on a work surface and closure 125 is closed. With this feature, tray 105 is not required to be near a sink with the spout of closure 125 overhanging an edge of the sink. Tray 105 may be used wherever convenient with closure 125 ensuring that any liquid on the first draining surface of tray 105 is captured within the perimeter walls. For some applications, dish rack system 100 is configured so that tray 105 is used alone, such as to dry a set of wine glasses or the like. In other modes, dish rack system 100 includes cup 120 disposed in the cup-stowage area of tray 105, so that small items and utensils may be cleaned and dried conveniently without requiring the user find suitable space and configure a large footprint drying solution for tasks that could be accomplished with a small footprint drying solution. Tray 105 with or without cup 120 provides such a convenient small footprint drying solution.

When a larger footprint drying solution is needed, the user may reconfigure dish rack system 100 by unfolding folding platform 110 and deploying it on top of tray 105 (with or without cup 120 as needed or desired). Central drain region 135 is preferably centered over the first drain surface of tray 105. When cup 120 is not used, unfolded folding platform 110 is centered in X and Y dimensions on tray 105. When cup 120 is disposed in the cup-stowage area, unfolded folding platform 110 is shifted in the Y dimension away from the cup-stowage region but central drain region 135 remains overlying the first draining surface of tray 105.

Dish rack system 100 is functional in this configuration to provide the second draining surface for supporting and drying larger objects, such as pots, pans, and the like. For plates and other objects that may benefit from, or have an option for, being supported and dried in a vertical fashion, the user may couple one or more pivoting tine members 115 onto the second drying surface. One or more of the pivoting tine members 115 may be rotated outward or folded flat as needed or desired, depending upon the desired configuration. The components may be folded and disassociated as desired to quickly and efficiently store dish rack system 100 out of the way.

Figure 5:
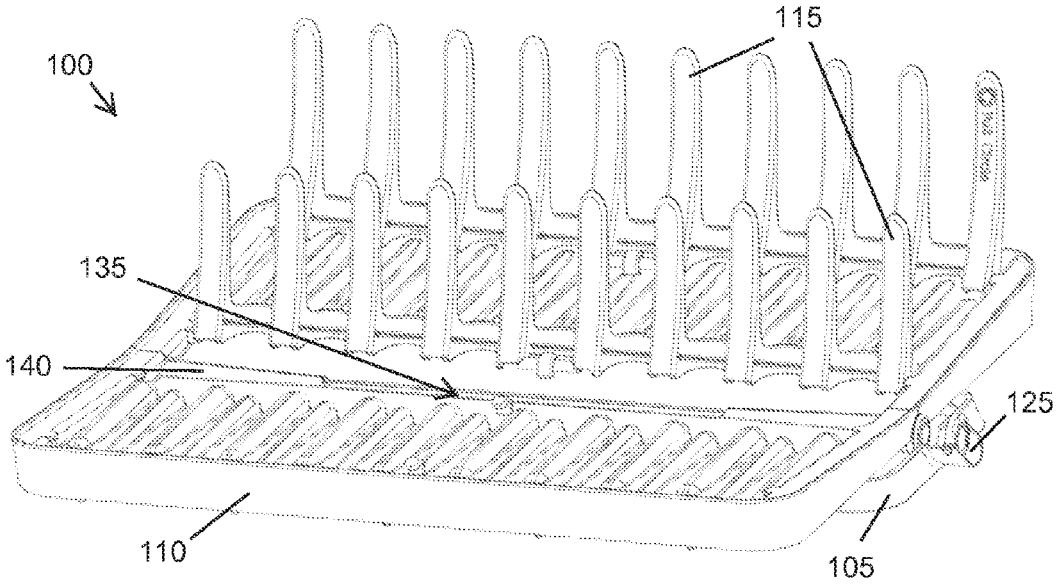
FIG. 5 illustrates a side perspective view of a secondary mode for the dish rack system of FIG. 1 that provides a pair of pivoting tine members on one half tray only and dispenses with the cup.
Figure 6:
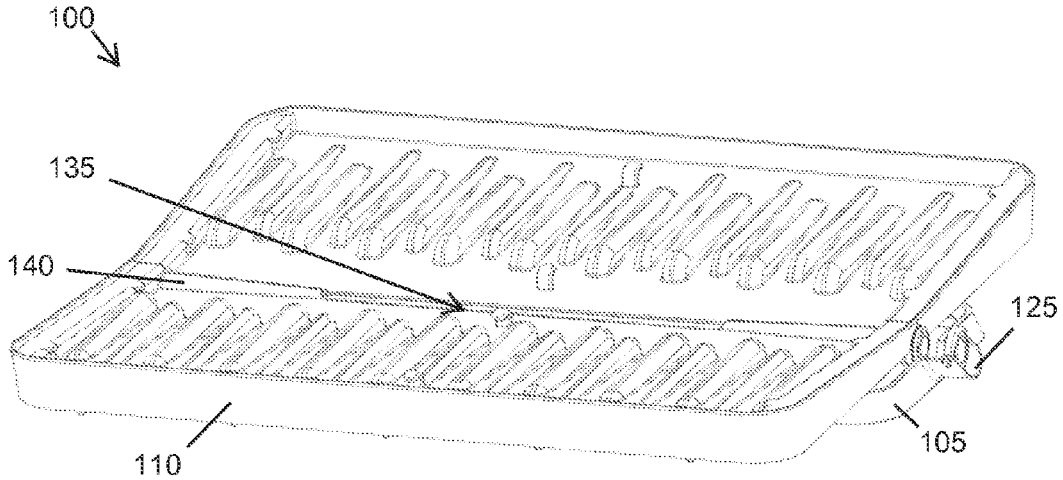
FIG. 6 illustrate a side perspective view of an alternative configuration mode for the dish rack system of FIG. 1 that uses the tray and the folding platform only without any pivoting tine members and cup.

FIG. 5 illustrates a side perspective view of a secondary mode for dish rack system 100 that provides a pair of pivoting tine members 115 on one half tray 130 only and dispenses with cup 120. FIG. 6 illustrate a side perspective view of an alternative mode for dish rack system 100 that uses tray 105 and folding platform 110 only without pivoting tine members 115 and cup 120.

Figure 7:
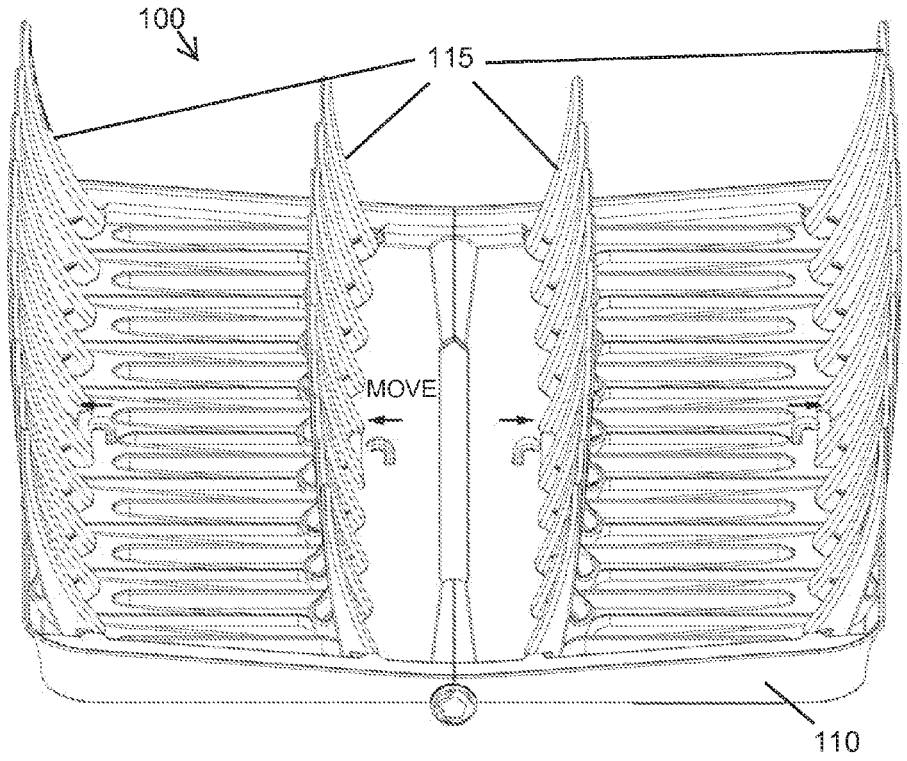
FIG. 7 illustrates an overhead perspective view of the dish rack system of FIG. 1 depicting a step in removing pivoting tine members from the folding platform.
Figure 8:
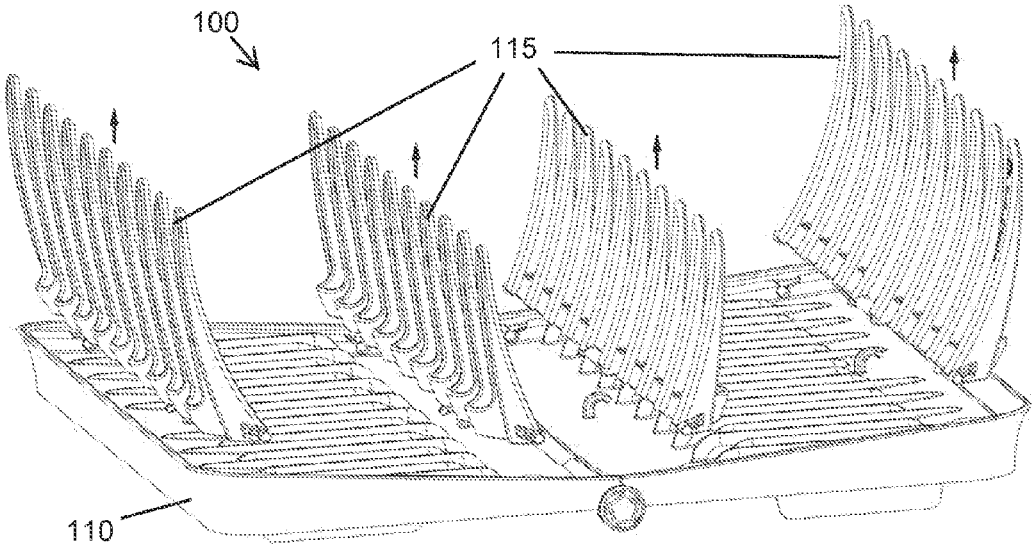
FIG. 8 illustrates a side perspective view of the dish rack system of FIG. 1 depicting a subsequent step (relative to FIG. 7) in removing the pivoting tine members from the folding platform.

FIG. 7 illustrates an overhead perspective view of dish rack system 100 depicting a step in removing pivoting tine members 115 from folding platform 110. FIG. 8 illustrates a side perspective view of dish rack system 100 depicting a subsequent step (relative to FIG. 7) in removing pivoting tine members 115 from folding platform 110. In FIG. 7, pivoting tine members 115 are rotated to their extended outward projecting configuration and then each is moved laterally away from central drain region 135 to decouple from pivot points 150 and lateral channels. In FIG. 8, each pivoting tine member is removed from the second drain surface by lifting it up and away.

The system and methods above has been described in general terms as an aid to understanding details of preferred embodiments of the present invention. In the description herein, numerous specific details are provided, such as examples of components and/or methods, to provide a thorough understanding of embodiments of the present invention. Some features and benefits of the present invention are realized in such modes and are not required in every case. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. A dish rack system, comprising:

a tray providing a first generally planar draining surface having a first surface area with a first width and a first length greater than said first width; and a folding platform independent from and unattached to said tray and including a pair of half trays rotatably coupled to each other about a rotation axis aligned with a longitudinal axis and with said rotation axis generally perpendicular to a lateral axis, said folding platform including an unfolded mode and a folded mode, with said tray configured to support said folding platform when said folding platform is in said unfolded mode, said unfolded mode providing an unfolded width for said folding platform greater than said first width and providing an unfolded length along said longitudinal axis;

wherein said pair of half trays are aligned in a plane and define a second generally planar draining surface having a drain region overlying said tray when said folding platform is in said unfolded mode and supported by said tray, each half tray including an inner edge substantially parallel to said rotation axis and further including an outer edge opposite of said inner edge and each half tray including a plurality of drain elements generally parallel to said lateral axis;

wherein said pair of half trays are generally parallel to each other with said outer edges proximate each other when said folding platform is in said folded mode producing a pair of proximated outer edges with said proximated outer edges configured to freestand said folding platform when in said folded mode and said outer edges proximated to each other; and wherein said second generally planar draining surface includes a second surface area with a second width and a second length, said second surface area greater than said first surface area.

2. The dish rack system of claim 1 wherein said proximated outer edges have a rectilinear perimeter envelope with a perimeter width and a perimeter length with said folding platform configured to be supported by said tray when in said folded mode with said perimeter width less than said first width and with said perimeter length less than said first length.

3. The dish rack system of claim 2 wherein said second length is about equal to said first length.

4. The dish rack system of claim 1 wherein said tray includes a closure system having a spout and a selectively closeable/openable drain.

5. The dish rack system of claim 1 wherein said drain region is centrally disposed in said second generally planar draining surface with said drain region disposed at a junction of said pair of half trays proximate said inner edges.

6. The dish rack system of claim 5 wherein said folding platform provides said rotatable coupling of said half trays with a pair of laterally extending hinges with said drain region defined therebetween.

7. The dish rack system of claim 1 wherein each half tray of said pair of half trays define a portion of said second draining surface on an upper exterior surface and wherein said pair of half trays rotate with said portions of said second draining surface disposed on an outside of said folding platform when said folding platform is in said folded mode.

8. The dish rack system of claim 6 wherein each half tray of said pair of half trays define a portion of said second draining surface on an upper exterior surface and wherein said pair of half trays rotate with said portions of said second draining surface disposed on an outside of said folding platform when said folding platform is in said folded mode.

9. The dish rack system of claim 1 further comprising a pivoting tine member including a plurality of tines, said pivoting tine member detachably rotatably coupled to one of said half trays of said pair of half trays, said pivoting tine member rotating between an outwardly extending mode and a planar mode wherein said plurality of tines are generally perpendicular to said second draining surface in said outwardly extending mode and wherein said plurality of tines are generally parallel to said second draining surface in said planar mode.

10. The dish rack system of claim 8 further comprising a plurality of pivoting tine members each including a plurality of tines, with each said plurality of pivoting tine members rotatably coupled to a respective half tray of said pair of half trays, each said pivoting tine member rotating between an outwardly extending mode and a planar mode;

wherein said plurality of tines are generally perpendicular to said second draining surface in said outwardly extending mode;

wherein said plurality of tines are generally parallel to said second draining surface in said planar mode;

wherein said pair half trays rotate about a central axis when said folding platform transitions between said folded mode and said unfolded mode;

wherein said plurality of pivoting tine members each rotate about an axis parallel to said central axis when transitioning between said outwardly extending mode and said planar mode; and wherein said plurality of tines of said plurality of pivoting tine members rotate towards said drain region when transitioning from said outwardly extended mode to said planar mode.

11. The dish rack system of claim 10 wherein said plurality of pivoting tine members rotate independently with respect to each other.

12. The dish rack system of claim 10 wherein said plurality of pivoting tine members are repeatedly attachable to, and detachable from, said folding platform.

13. The dish rack system of claim 11 wherein said plurality of pivoting tine members are repeatedly attachable to, and detachable from, said folding platform.

* * * * *